US005990403A

United States Patent [19]

Membreno et al.

[11] Patent Number: 5,990,403

[45] Date of Patent: Nov. 23, 1999

[54] LYRE MOUNTING BRACKET FOR A MUSICAL INSTRUMENT TUNER

[75] Inventors: Agustin J. Membreno, Carrollton; Mark L. Wilson, Dallas; Kerry W. Whitaker, Plano, all of Tex.

[73] Assignee: Onboard Research Corporation, Carrollton, Tex.

[21] Appl. No.: 09/209,333

[22] Filed: Dec. 11, 1998

[51] Int. Cl.[6] ..... G10G 7/02

[52] U.S. Cl. ..... 84/454; 84/453

[58] Field of Search ..... 84/453, 454, 387 A, 84/329

[56] References Cited

U.S. PATENT DOCUMENTS 3,543,633 12/1970 Batten ..... 84/453

*Primary Examiner*—Karen Masih
*Assistant Examiner*—Shih-Yung Hsieh
*Attorney, Agent, or Firm*—Mark W. Handley

[57] ABSTRACT

A lyre mounting bracket (14) is provided for acoustically coupling a musical instrument tuner (12) to a lyre (16) for a musical instrument (10). The tuner (12) includes an electronics section (26) having a vibratory sensor. A hinged elbow member (44) secures the mounting bracket (14) to the tuner (12). The mounting bracket (14) has a main body (42) which includes two oppositely facing, planar surfaces (50, 52) for securing directly between a clamp (20) of the lyre (16). Support braces (58, 60) extend outward from opposite sides of the main body (42), each having arcuately shaped sides (66–76) which extend orthogonal to and adjacent to the peripheral edges of respective ones of the planer mounting surfaces (50, 52). The sides (66–76) have profiles which fit substantially flush with portions of a profile (94) defined by the peripheral edges of a first half (90) of the lyre clamp (20). The first half (90) of the lyre clamp (20) includes two lobes (96, 98) which fit substantially flush against mounting ears (54, 56) defined by the main body (42) of the mounting bracket (14). The support braces (58, 60) further include protuberances (78, 80) which extend into crooks (97, 99) of the profile (94) of the first half (90) of the lyre clamp (20). The arcuately shaped sides (66–76) and the protuberances (78, 80) of the support braces (58, 60), and the planar mounting surfaces (50, 52) together define two oppositely facing sockets (62, 64) for receiving the two parts (90, 92) of the lyre clamp (20) in a closely fitting relation, such that the lyre mounting bracket (14) is acoustically coupled to the lyre (16) for transmitting mechanical vibration therebetween.

14 Claims, 2 Drawing Sheets

FIG. 1
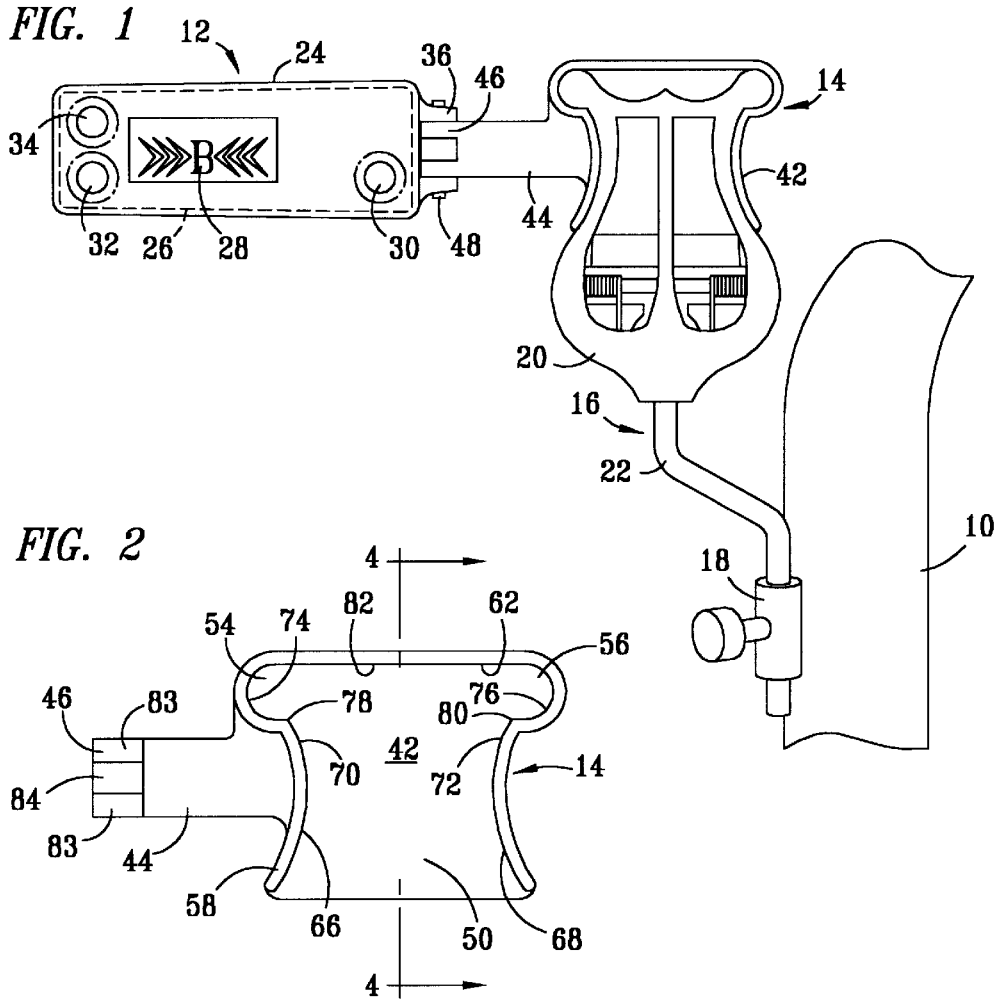
FIG. 2
FIG. 3
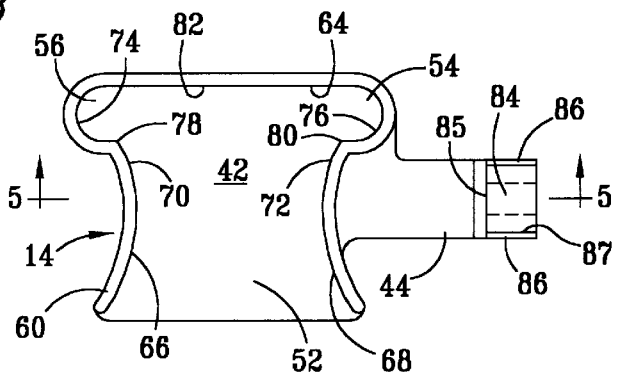
FIG. 4
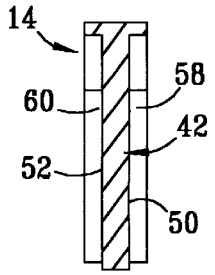
FIG. 5
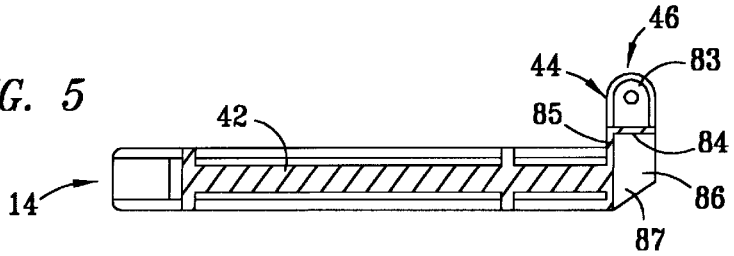

LYRE MOUNTING BRACKET FOR A MUSICAL INSTRUMENT TUNER

CROSS REFERENCE TO RELATED APPLICATIONS

This present application is related to U.S. Pat. No. D402, 684 having application Ser. No. 29/067,790, scheduled to issue on Dec. 15, 1998, entitled "Musical Instrument Tuner," and invented by Mark L. Wilson, et al.

TECHNICAL FIELD OF THE INVENTION

The present invention relates in general to tuners for musical instruments, and in particular to a mounting bracket for securing and acoustically coupling an electro-mechanical musical instrument tuner to a lyre which is mounted to a musical instrument.

BACKGROUND OF THE INVENTION

Electro-mechanical musical instrument tuners have been provided for acoustically coupling to musical instruments for sensing mechanical vibrations of the musical instruments to determine the pitch of tones being emitted by the musical instruments. The detected pitch is then utilized to provide an output indicating the pitch of the tone being played. The musical instrument tuners can be utilized both for tuning the musical instruments and for developing a person's ear for detecting the pitch being played, such as for teaching a person to recognize various intonations. Musical instrument tuners have been clamped directly to the instruments using C-type clamps to acoustically couple the tuners to the instruments, such that mechanical vibrations will pass to a vibratory motion detector mounted within the housing of the tuner. The C-type clamps typically have a threaded clamping member which is subject to over tightening of the threaded coupling, which may cause damage to the musical instruments from excessive forces being applied to the instrument. Alligator clips have also been used to clip musical instrument tuners to instruments, which may result in teeth of the alligator clips placing scratch marks on the exterior of the instruments.

Musical instruments such as brass and woodwind instruments often have an attached clamp for holding sheet music, which is called a lyre. Such clamps have a lower clamping member which is typically mounted to the instrument and clamps an elongated member to the musical instrument. The opposite end of the elongated member has a second clamp which is spring biased and which is utilized to clamp sheet music to the instrument, such that a person playing the instrument may view the sheet music. Such lyres have often been made such that the upper clamps have an arcuately shaped profile defined by peripheral edges of one of the clamp members which is of a particular shape of an ancient Greek lyre, or harp. The arcuately shaped profile includes two lobes on an upper portion thereof, which are pressed against the back of the sheet music to hold the sheet music in position. The upper clamps also typically include a clamp member having two arcuately shaped prongs which extend in an upwardly direction for clamping against the front side of the sheet music, while causing minimal interference with viewing of the outer page of the sheet music.

SUMMARY OF THE INVENTION

A lyre mounting bracket for acoustically coupling a musical instrument tuner to a lyre for a musical instrument has a main body which includes two oppositely facing, planar surfaces for securing directly between first and second halves of a clamp of the lyre. The musical instrument tuner includes an electronics section having a vibratory sensor. The first half of the lyre clamp includes two lobes which fit flush against mounting ears defined by a profile of the main body of the mounting bracket. The mounting bracket includes support braces which extend outward on opposite sides of the main body. Each of the support braces includes arcuately shaped sides which extend orthogonal to respective ones of the planer mounting surfaces, and which have profiles which correspond to and fit substantially flush with portions of the peripheral edges of the first half of the lyre clamp. The support braces further includes protuberances which extend into crooks defined by the edges of the first half of the lyre clamp. The arcuately shaped sides and the protuberances of the support braces, and the planar mounting surfaces together define two oppositely facing sockets for receiving the lyre clamp in a closely fitting relation, such that the first half of the lyre clamp is pressed flush against one of the planar mounting surfaces to acoustically couple the lyre mounting bracket to the lyre for transmitting mechanical vibration therebetween.

BRIEF DESCRIPTION OF THE DRAWINGS

For a more complete understanding of the present invention and the advantages thereof, reference is now made to the following description taken in conjunction with the accompanying Drawings in which:

FIG. 1 is a front, elevation view of a musical instrument tuner and a lyre mounting bracket which are clamped to a lyre of a musical instrument;

FIG. 2 is a front, elevation side view of the lyre mounting bracket;

FIG. 3 is a rear, elevation view of the lyre mounting bracket;

FIG. 4 is a sectional view of the lyre mounting bracket, taken along section line 4—4 of FIG. 2;

FIG. 5 is a sectional view of the lyre mounting bracket, taken along section line 5—5 of FIG. 3;

DETAILED DESCRIPTION OF THE INVENTION

Figure 6:
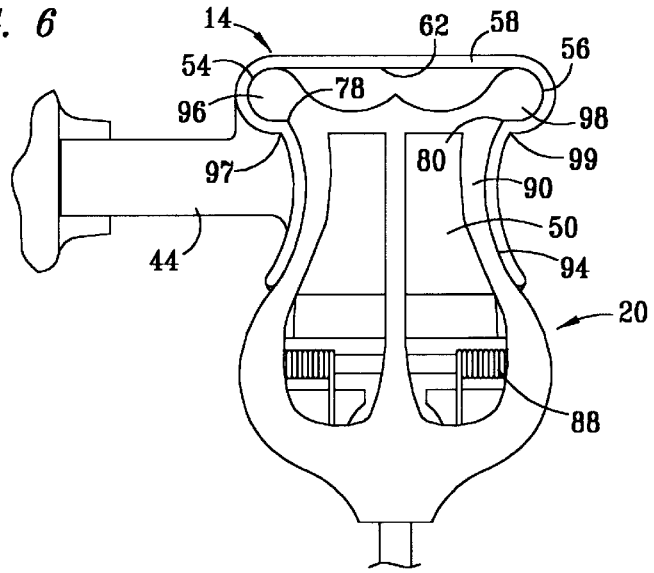
FIG. 6 is a front, elevation view of the lyre mounting bracket secured within the lyre of the musical instrument.

FIG. 1 is a front, elevation view of a musical instrument tuner 12 having a lyre mounting bracket 14 which is mounted to a lyre 16 of a musical instrument 10. The lyre 16 includes a lower clamp 18 for mounting the lyre 16 to the musical instrument 10, and upper clamp 20 of the type for securing sheet music thereto. An elongated mounting member 22 extends between the lower clamp 18 and the upper clamp 20. The musical instrument tuner 12 has a housing 24. An electronics unit 26, which includes a vibratory sensor, is fixedly mounted within the housing 24. The instrument tuner 12 further includes an output screen 28 which is mounted to a central portion of the housing 24. Operating buttons 30, 32 and 34 are provided. Preferably, the operating button 30 operates an on-off power switch. The operating button 32 is preferably a three position button for transposing a letter output represented on the display screen between equivalent notes for different keys. The operating button 34 is preferably a three position button which selects between three different reference frequencies which are two Hz apart to vary the frequency calibration of the instrument tuner 2 by two Hz. The three different reference frequencies preferably correspond to an A note, and are approximately equal to 438.0 Hz, 440.0 Hz and 442.0 Hz. The housing 24 includes a hinge connection 36, which pivotally secures the musical instrument tuner 12 to the mounting bracket 14. The mounting bracket 14 includes a main body 42 and an elbow member 44. The elbow member 44 is preferably rigidly mounted to the main body 42, and pivotally mounted to the housing 24 of the musical instrument tuner 12. A hinge connection 46 is rotatably secured to the hinge connection 36 by a hinge pin 48.

FIG. 2 is a front, elevation view of the mounting bracket 14. The mounting bracket 14 has a flat or planer surface 50 against which a first half of the lyre's upper clamp 20 (not shown in FIG. 2) is pressed. The main body 42 has an exterior profile such that the periphery of the planer surface 50 extends to define mounting ears 54 and 56. A support brace 58 extends around the peripheral edge of the flat surface 50, preferably extending continuously and orthogonally thereto. Support brace 58 is provided by a singular, continuous, forwardly protruding rib having an arcuate shape which, together with the planar surface 50, defines a socket 62 for receiving a first portion of the upper clamp 20 of the lyre 16 in a closely fitting relation. The support brace 58 defines lower curved sides 66 and 68, central side portions 70 and 72, and upper arcuate sides 74 and 76 which will preferably fit substantially flush against edges of the portion of the lyre 16 which is shaped like an ancient Greek lyre, or harp. Protuberances 78 and 80 extend between respective ones of the central side portion 70 and the upper arcuate side 74, and the central side portion 72 and the upper arcuate side 76. An upward side 82 is also defined by the support brace 58.

FIG. 3 is a rear, elevation view of the mounting bracket 14. The main body 42 of the mounting bracket 14 has a planer surface 52, which is on an opposite side of the main body 42 and faces in an opposite direction from that of the planar surface 50. The planar surface 52 has a peripheral edge which defines a profile of the main body 42 that provides the mounting ears 54 and 56. A support brace 60 extends around the peripheral edge of the planer surface 52, preferably orthogonal to the surface 52. The support brace 60 and the planar surface 52 together define a socket 64 for receiving a second portion of the upper clamp 20 of the lyre 16. The support brace 60 defines sides which are the same as those for the support brace 58, with the planar surface 52 and the support brace 60 preferably being the same shape and size as the planar surface 50 and the support brace 58. Like numbers are used herein to define oppositely facing portions of the main body 42. The socket 64 includes lower curved sides 66 and 68, central side portions 70 and 72, upper arcuate sides 74 and 76 and top side edge 82. The protuberances 78 and 80 extend between respective ones of the central side portion 70 and the upper arcuate side 74, and the central side portion 72 and the upper arcuate side 76. The sockets 62 and 64 are sized for closely fitting, substantially flush against the edges of harp-shaped portion of the upper lyre clamp 20, which is herein defined as a closely fitting relation. Preferably, the sockets 62 and 64 can be used interchangeably with either side of the lyre clamp 20.

FIG. 4 is a sectional view of the mounting bracket 14, taken along section line 4—4 of FIG. 2. It is shown as being a solid member, preferably formed of a thermoplastic. The planer surfaces 50 and 52 face in opposite directions, with the support braces 58 and 60 disposed adjacent to and preferably orthogonal to the respective ones of the planer surfaces 50 and 52.

FIG. 5 is a sectional view of the mounting bracket 14, taken along section line 5—5 of FIG. 3. The mounting bracket 14 is preferably molded of thermoplastic as a singular, unitary member which includes the main body 42 and the elbow member 44. The elbow member 44 includes the hinge connection 46. The hinge connection 46 includes two hinge tabs 83 (one shown), which are preferably solid and which are connected to a singular, solid planar member 84. The planar member 84 is connected on one edge to an edge of a singular planar member 85. Two gussets members 86 (one shown) are connected on two edges of the planar member 84 and to two edges of the planar member 85, and are molded as a single piece with the main body 44. A void space 87 extends adjacent to the two planar members 84 and 85, and between the two gusset members 86.

FIG. 6 is a front, elevation view of the mounting bracket 14 after being clamped within clamp 20. The upper clamp 20 includes a first clamp member 90 and a second clamp member 92 (shown in FIG. 7) which are pivotally secured together and urged toward one another by a biasing spring 88. The first clamp member 90 is preferably a flat member made of metal, but plastic and other suitable materials may be used. The first clamp member 90 has a profile 94 which is preferably that of an ancient Greek lyre, or harp, having lobes 96 and 98. A flat surface of the first clamp member 90 defines the profile 94, and is pressed substantially flush against the planar surface 50 of the mounting bracket 14 by the spring 88. The lobes 96 and 98 fit flush against the ears 54 and 56, respectively, of the main body 42 of the mounting bracket 14. The profile 94 of the first clamp member 90 fits flush against the support brace 58 which defines a socket 62. The protuberances 78 and 80 fit within crooks, or recesses, 97 and 99 of the profile 94 of the first upper clamp 90, such that the lobes 96 and 98 are firmly secured within the upper portion of the socket 62 defined by the ears 54 and 56 and the support brace 58.

Figure 7:
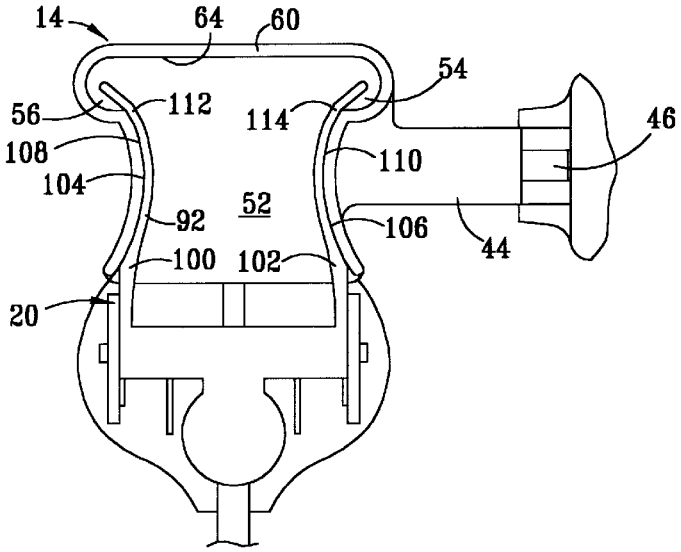
FIG. 7 is a rear, elevation view of the lyre mounting bracket secured within a lyre of the musical instrument.

FIG. 7 is a rear, elevation view of the mounting bracket 14 after being secured within the clamp 20. The second clamp member 92 of the upper clamp 20 has two upwardly extending, elongated prongs 100 and 102 having edge profiles 104 and 106. The elongated prongs 100 and 102 may be formed such that the edge profiles 104 and 106 fit closely against, or flush with, the lower and central portions of the support brace 60. The edge profiles 104 and 106 of respective ones of the prongs 100 and 102 preferably have crooks 108 and 110, respectively. The prongs 100 and 102 may also be formed such that the crooks 108 and 110 fit flush against the support brace 60. The two elongated prongs 100 and 102 have portions 112 and 114 which are adjacent to the terminal ends of the rods 100 and 102. The portions 112 and 114 are pressed against the mounting ear portions 54 and 56, respectively, of the planer surface 52.

Figure 8:
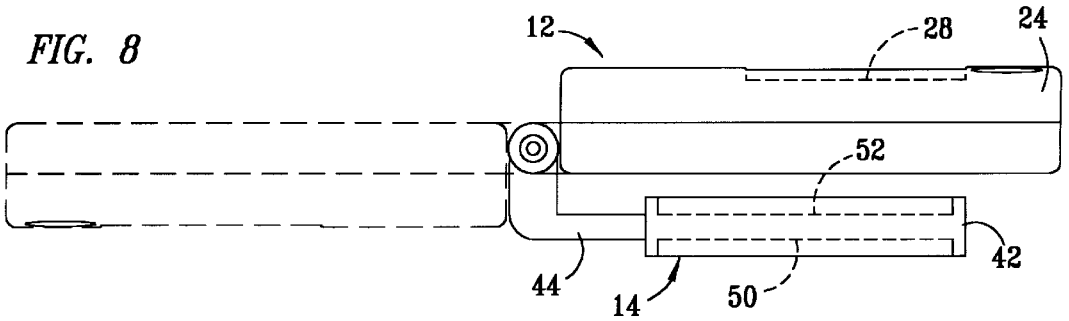
FIG. 8 is a top view of the musical instrument tuner and the lyre mounting bracket.

FIG. 8 is a top view of the musical instrument tuner 12 and the mounting bracket 14, which is in a configuration for mounting to the lyre 16 of a musical instrument (not shown in FIG. 8). The elbow member 44 is depicted as being a right-angled member for mounting the main body 42 of the clamp 14 to the musical instrument tuner 12. The housing 24 of the musical instrument tuner 12 is folded in the relation shown to the main body 42 of the mounting clamp 14, such that the view screen 28 faces forward from the front face of the musical instrument tuner 12 and the lyre for observation when mounted to the lyre. It also should be noted that the mounting bracket 14 can be used in a reverse position such that the screen 28 of the musical instrument tuner 12 may be viewed when disposed in the position shown in phantom, which corresponds to the relative positions of the tuner 12 and the lyre mounting bracket 14 shown in FIG. 1.

The lyre mounting bracket described herein may be used for rigidly securing a musical instrument tuner to a musical instrument using a standard lyre, such that the tuner is acoustically coupled to the musical instrument. A standard lyre clamp is utilized, such that a C-clamp or an alligator clip is not required to mount the musical instrument tuner to the instrument, and thus damage to the musical instrument from over-tightening the C-clamp or from the teeth of the alligator clip is avoided.

Although the preferred embodiment has been described in detail, it should be understood that various changes, substitutions and alterations can be made therein without departing from the spirit and scope of the invention as defined by the appended claims.

What is claimed is:

1. A mounting bracket for acoustically coupling a musical instrument tuner to a lyre, comprising:

a main body having a planar surface and a second surface which face in opposite directions, said planar surface including a peripheral edge which is arcuately shaped to define two spaced apart mounting ear portions;

a support brace which extends adjacent to said peripheral edge of said planar surface, said support brace having a side which is adjacent to and orthogonal to said planar surface, wherein said side of said support brace extends for fitting substantially flush with a periphery of the lyre; and said second surface of said main body being aligned with said planar surface such that the lyre will clamp to said main body, with a first clamp portion of the lyre fitting flush against said planar surface, and a second clamp portion of the lyre pressing against the second surface and pressing the first clamp portion of the lyre against said planar surface.

2. The mounting bracket for acoustically coupling a musical instrument tuner to a lyre according to claim 1, further comprising an elbow member which is rigidly mounted to said main body to extend with a first portion which is parallel to said planar surface, a second portion which is perpendicular to said planar surface, and further including a hinge connection for pivotally mounting said musical instrument tuner to said main body.

3. The mounting bracket for acoustically coupling a musical instrument tuner to a lyre according to claim 2, wherein said hinge connection comprises a hinge tab which extends outward from a first planar member, a second planar member which is directly adjacent to said planar surface and connected on one end to said first planar member, a gusset member which extends between said first and second planar members, and a void space extending adjacent to said first and second planar members and said gusset member, such that said void spaced is disposed on an opposite side of said first planar member from said hinge tab member.

4. The mounting bracket for acoustically coupling a musical instrument tuner to a lyre according to claim 3, wherein said main body, said first and second planar members, and said gusset member are molded of thermoplastic as a singular part.

5. The mounting bracket for acoustically coupling a musical instrument tuner to a lyre according to claim 1, wherein said side surface of said support brace has two oppositely facing protuberances which extend adjacent to lower edges of said mounting ear portions of said main body, such that said protuberances engage snugly against crooks in respective ones of lobes of the first clamp portion of the lyre.

6. The mounting bracket for acoustically coupling a musical instrument tuner to a lyre according to claim 5, wherein said main body and said support brace are molded of thermoplastic as a singular part.

7. A mounting bracket for acoustically coupling a musical instrument tuner to a lyre, comprising:

a main body having first and second planar surfaces which are parallel and face in opposite directions, and said first and second planar surfaces having peripheral edges which extend with arcuately shaped edges to define two spaced apart mounting ear portions for said mounting body;

a first support brace which extends adjacent to a first one of said peripheral edges of said first planar surface, and said first support brace having a first side which is adjacent to and orthogonal to said first planar surface;

a second support brace which extends adjacent to a second one of said peripheral edges of said second planar surface, and said second support brace having a second side which is adjacent to and orthogonal to said first planar surface;

said first and second support braces being spaced apart on opposite side of said main body, and one of said first and second sides of said first and second support braces fitting substantially flush against at least a first portion of a clamp of the lyre when the first portion is disposed adjacent to said one of said first and second support braces; and wherein the first and second portions of the clamp of the lyre are firmly pressed against respective ones of said first and second planar surfaces of said mounting bracket, such that a flat surface of the first portion of the clamp having a periphery which defines a profile of the lyre will fit substantially flush against one of said first and second planar surfaces and at least a portion of the periphery of the flat surface will fit substantially flush with a respective one of said first and second support braces.

8. The mounting bracket for acoustically coupling a musical instrument tuner to a lyre according to claim 7, wherein said side surfaces of said first and second support braces each have two oppositely facing protuberances which extend adjacent to lower edges of said mounting ear portions of said main body and corresponding ones of said first and second planar sides, such that said protuberances engage substantially flush against crooks in lobes of the first portion of the clamp of the lyre.

9. The mounting bracket for acoustically coupling a musical instrument tuner to a lyre according to claim 7, further comprising an elbow member which is rigidly mounted to said main body to extend with a first portion which is parallel to said first and second planar surfaces, a second portion which is perpendicular to said first and second planar surfaces, and further including a hinge connection for pivotally mounting said musical instrument tuner to said main body.

10. The mounting bracket for acoustically coupling a musical instrument tuner to a lyre according to claim 9, wherein said hinge connection comprises a hinge tab member which extends outward from a first planar member, a second planar member which is directly adjacent to said first and second planar surfaces and connected on one end to said first planar member, two gusset member which extend between said first and second planar members, and a void space extending adjacent to said first and second planar members and between said gusset members, such that said void spaced is disposed on an opposite side of said first planar member from said hinge tab member.

11. The mounting bracket for acoustically coupling a musical instrument tuner to a lyre according to claim 10, wherein said main body, said first and second support braces, said first and second planar members, and said gusset members are molded of thermoplastic as a singular part.

12. A mounting bracket for acoustically coupling a musical instrument tuner to a lyre, comprising:

a main body having first and second planar surfaces which are parallel and face in opposite directions, and said first and second planar surfaces having peripheral edges which extend with arcuately shaped edges;

a first support brace which continuously extends adjacent to three sides of a first one of said peripheral edges of said first planar surface, and said first support brace having a first side which is adjacent to and orthogonal to said first planar surface;

a second support brace which continuously extends adjacent to three sides of a second one of said peripheral edges of said second planar surface, and said second support brace having a second side which is adjacent to and orthogonal to said first planar surface;

said first and second support braces being spaced apart on opposite sides of said main body, and said first and second sides which are adjacent to said peripheral edges of said first and second planar surfaces each having a profile for fitting substantially flush against at least one of first and second clamp members of a clamp of the lyre;

said side surfaces of said first and second support braces each having two oppositely facing protuberances which extend adjacent to lower edges of said mounting ear portions of said main body and corresponding ones of said first and second planar sides, such that said protuberances engage snugly against crooks in lobes of one of the first and second clamp members of the lyre; and an elbow member which is rigidly mounted to said main body to extend with a first portion which is parallel to said first and second planar surfaces, a second portion which is perpendicular to said first and second planar surfaces, and further including a hinge connection for pivotally mounting said musical instrument tuner to said main body.

13. The mounting bracket for acoustically coupling a musical instrument tuner to a lyre according to claim 12, wherein said hinge connection comprises two hinge tabs which extend outward from a first planar member, a second planar member which is directly adjacent to said first and second planar surfaces and connected on one end to said first planar member, two gusset members which extend between said first and second planar members, and a void space extending adjacent to said first and second planar members and between said gusset members, such that said void spaced is disposed on an opposite side of said first planar member from said hinge tab members.

14. The mounting bracket for acoustically coupling a musical instrument tuner to a lyre according to claim 13, wherein said main body, said first and second support braces and said hinge connection member are molded as a singular part.

* * * * *